United States Patent [19]

Powell

[11] Patent Number: 4,750,241

[45] Date of Patent: Jun. 14, 1988

[54] CABLE TIES

[75] Inventor: Terence J. Powell, Stroud, Great Britain

[73] Assignee: Critchley Limited, Stroud, United Kingdom

[21] Appl. No.: 28,382

[22] Filed: Mar. 19, 1987

[30] Foreign Application Priority Data

Mar. 25, 1986 [GB] United Kingdom ..... 8607379
Oct. 7, 1986 [GB] United Kingdom ..... 8624054

[51] Int. Cl.[4] ..... B65D 63/00

[52] U.S. Cl. ..... 24/16 R; 24/20 R; 24/20 EE

[58] Field of Search ..... 24/16 R, 17 R, 17 B, 24/17 AP, 20 EE, 20 R, 23 EE, 487; 248/74.3

[56] References Cited

U.S. PATENT DOCUMENTS

| | | | |
|---|---|---|---|
| 483,040 | 9/1892 | Binet | 24/20 R |
| 580,199 | 4/1897 | Sommerfeld | 24/20 EE |
| 622,687 | 4/1899 | Holyland et al. | 24/20 EE |
| 842,240 | 1/1907 | Peck | 24/17 AP |
| 881,053 | 3/1908 | Brigance | 24/20 EE |
| 912,820 | 2/1909 | Davis | 24/20 EE |
| 995,691 | 6/1911 | Latham | 24/20 EE |
| 1,084,407 | 1/1914 | Deist | 24/20 EE |
| 1,516,682 | 11/1924 | Peabody | 24/20 EE |
| 2,551,384 | 5/1951 | Middleton et al. | 24/20 EE |
| 4,468,840 | 9/1984 | Sauer et al. | 24/20 R |

FOREIGN PATENT DOCUMENTS 1032303 6/1966 United Kingdom ..... 24/20 EE

OTHER PUBLICATIONS

Patent *Application;* Gt. Brit. S. No. 2,117,821; published Jun. 10, 1982.

Patent *Application;* Gt. Brit. S. No. 2,168,103; published Jun. 11, 1986.

*Primary Examiner*—Victor N. Sakran

*Attorney, Agent, or Firm*—Young & Thompson

[57] ABSTRACT

A cable tie comprises a metal plate 1 from which projects a metal strap 2. After the strap has been passed around a bundle of cables to be held together the free end 7 of the strap is fed below a pair of lugs 10 and 11 and a bridge portion 3 and is then bent back over the bridge portion 3. Finally, the free end portion 7 is manipulated below the lugs 10 and 11 by first sliding one edge of the strap below the lug 10 so that it can then pass beyond the outer edge of the lug 11. When the strap is moved to lie in the normal longitudinal position it will be held securely below the two lugs 10 and 11. The lugs 10 and 11 are displaced longitudinally and their supports may also be directed outwardly as shown. An additional upstanding lug can be provided opposite the lug 11 to help to prevent undue lateral movement of the end of the strap 2.

10 Claims, 2 Drawing Sheets

CABLE TIES

This invention relates to cable ties, by which is meant a strapping device which can be wrapped around cables, pipes or the like and secured in place by linking together the two ends of the cable tie. Under certain conditions a very robust form of cable tie is required, such as for underwater intallations, where the cable tie may be subjected to rough conditions and corrosive effects. In such instances a metal cable tie covered with a protective coating may be needed. A problem then arises in securing the end of the strap of the cable tie after it has been wrapped around the article to which it is to be secured.

It is an object of this invention to provide means whereby the end of a cable tie may be secured with relative ease, since the strap may need to be applied under difficult conditions.

Accordingly this invention provides a cable tie comprising a plate with a projecting strap, the plate carrying on one face a first upstanding bridge portion defining a passageway generally aligned with the strap and of a width greater than the width of the strap, and a pair of lugs carried by upstanding lug supports to project in opposite directions inwardly towards the longitudinal centreline of the strap and the bridge portion, but which are displaced longitudinally with respect to one another to define a slot between them through which a free end portion of the strap, which has been wrapped around a cable, passed below the lugs and the bridge portion and bent back to overlie the bridge portion, can be manipulated to lie under one of the lugs, the width of the gap and the separation distance of the lug supports being such as to enable the free end portion of the strap to pass subsequently fully through the slot and then below the other lug so that when the free end of the strap is aligned with said longitudinal centreline, the free end portion of the strap will be held securely below both lugs.

The formation and positioning of the lugs with respect to the plate and the strap enable the free end of the strap to be manipulated with relative ease to lie under both of the lugs whilst providing substantial security against accidental release of the strap from beneath the lugs.

In the preferred construction at least one of the lug supports lies in a vertical plane which points outwardly in the direction away from the bridge portion with respect to said longitudinal centreline. This makes it possible for the free end of the strap to be twisted slightly out of the normal longitudinal direction so as to be manipulated with ease beneath the lugs. The free end of the strap will then tend to lie in the normal longitudinal direction where it is even less likely to be released accidentally from beneath the lugs in view of the twisting action which would be required in order to move the free end of the strap into a position where it can move out through the slot.

Ideally the free end of the first lug, which is situated nearest to the bridge portion, defines an edge which lies parallel to the vertical plane of its support. Preferably the free end of the second lug will also define an edge which lies parallel to said edge of the first lug.

The configuration employed wherein the lugs are displaced enables the separation distance between the lug supports to be kept quite small and preferably this separation distance will be less than 1.5 times the width of the strap. Desirably also the separation distance between the lug supports will be less than the internal width of the bridge portion.

Advantageously the cable tie may incorporate a third lug having an upstanding portion only, which is located directly opposite the one of the pair of lugs which is positioned furthest from the bridge.

Conveniently the lugs will be pressed out from the body of the plate. Further portions of the plate may also be cut out to enhance flexibility of the plate.

The invention may be performed in various ways and preferred embodiments thereof will now be described with reference to the accompanying drawings, in which.

Figure 1:
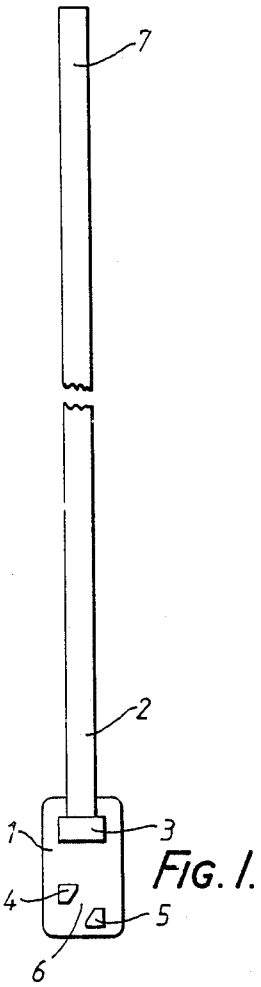
FIG. 1 is a plan view of one form of cable tie of this invention.

The cable tie shown in FIG. 1 comprises a plate 1 from which projects a strap 2. The parts of the cable tie are formed from a robust metal although the strap 2 is resilient so that it can be wrapped around articles and bent as required for fixing purposes. A first bridge portion 3 is formed at one end of the plate 1 whilst at the other end there is provided a pair of upstanding lugs 4, 5 which are displaced longitudinally with respect to one another and define a slot 6 between their free ends.

When the strap has been wrapped around an article to which it is to be attached, the free end 7 of the strap is fed below the lugs 4, 5 and the bridge portion 3, and is then bent back over the bridge portion 3. The remaining free end 7 of the strap is then twisted so that one edge can be slid through the slot 6 and below the first lug 4. The other edge of the strap can then be moved past the free edge of the other lug 5. When the end of the strap is subsequently moved to lie in the normal longitudinal position it will be held beneath portions of the two lugs 4 and 5.

Figure 2:
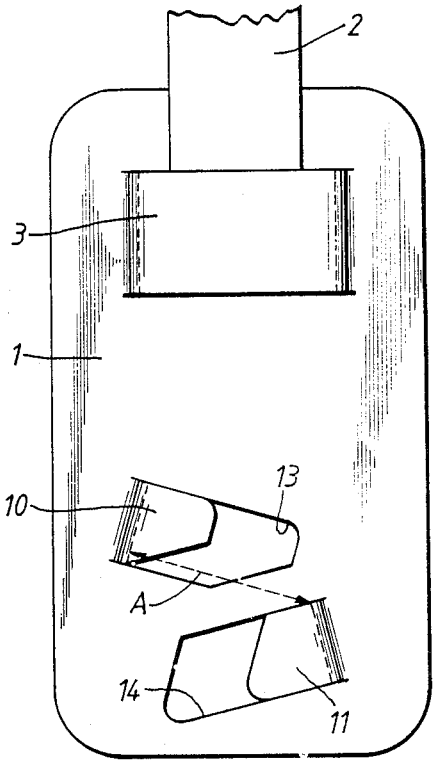
FIGS. 2 and 3 are plan and end views respectively of a plate portion of an alternative form of cable tie of this invention.
Figure 3:
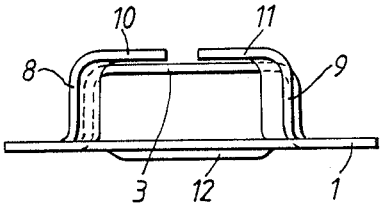
Figure 4:
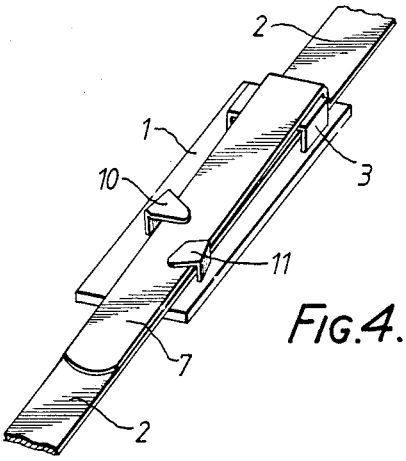
FIG. 4 is a perspective view of the cable tie of FIGS. 2 and 3 illustrating the method of securing the free end of the strap of the cable tie.

In an improved arrangement illustrated in FIGS. 2 and 3 the supports 8, 9 for lugs 10, 11 lie in vertical planes which point outwardly in the direction away from the bridge portion 3 with respect to the longitudinal centreline of the cable tie. This enables the free end of the strap 2 to be manipulated more easily beneath the two lugs 10, 11 during the twisting and lowering operation. The way in which the free end 7 of the strap 2 is located below the lugs 10, 11 is illustrated in FIG. 4.

The end of the plate 1 nearest to the bridge portion 3 incorporates a shallow depression 12 (FIG. 3) within which is welded one end of the strap 2. From FIG. 2 it can be seen that the lugs 10 and 11 and their supports 8 and 9 are pressed out from the plate 1 to leave slots 13, 14.

The method of construction employed for the cable tie illustrated in the drawings, whereby the lugs 4, 5 or 10, 11 are displaced in the longitudinal direction allows for the separation distance between the supports for the lugs to be kept quite small with respect to the width of the strap 2. Thus the separation distance A of the arrangement shown in FIG. 2 is less than 1.5 times the width of the strap 2. This difference becomes even smaller when the plate 1 and strap 2 have been coated with a protective material (paint or plastics).

Figure 5:
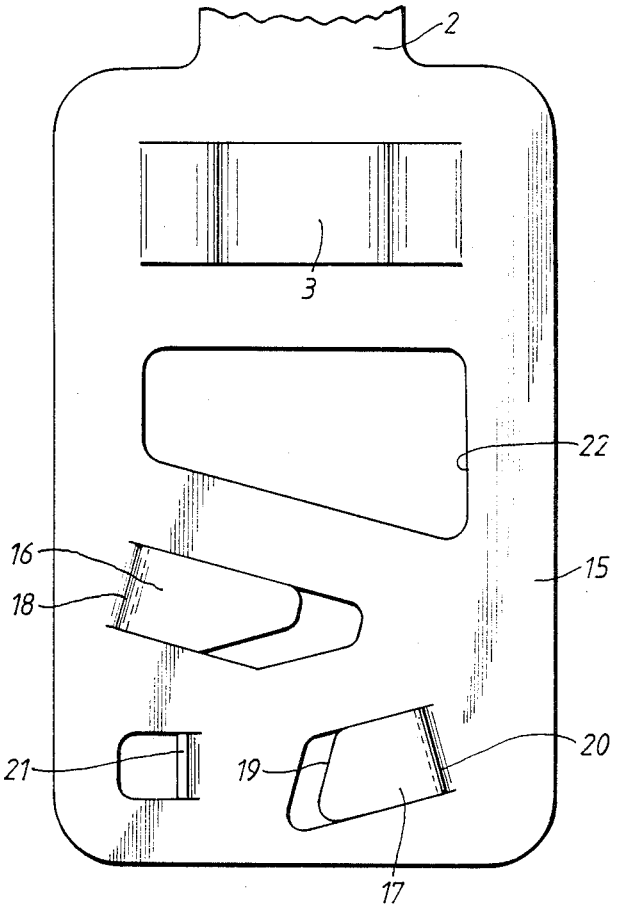
FIGS. 5 and 6 are plan and end views respectively of a plate portion of a still further embodiment of this invention.
Figure 6:
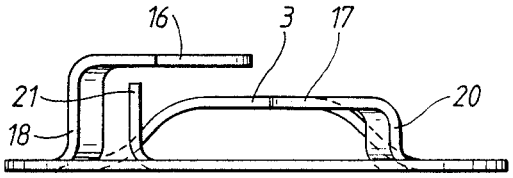

FIGS. 5 and 6 comprise plan and end views of another form of cable tie of this invention. This cable tie is in many ways very similar to that shown in FIGS. 2 and 3 and has a plate 15 provided with an integral strap 2. There are some other critical differences. Firstly, the lug 16 nearest to the bridge portion 3 is more elongated, whilst the lug 17 is slightly truncated, as compared with the arrangement shown in FIG. 2, resulting in a very near overlap of the two lugs, as can be seen from FIG. 6. Secondly, as also shown in FIG. 6, the lug 17 is situated in a lower plane than that of the lug 16. This arrangement creates a more secure fixing for the free end of the strap 2.

The free end portion of the strap 2 needs to be twisted only slightly so as to slide under the lug 16 whereupon it can be lowered below the plane of the lug 17 and then eased below the lug 17. Of course the distance between the free edge of the lug 17 and the support 18 for the lug 16 will be a little greater than the width of the strap 2 and it will be noted also that the support 18 and free edge 19 of the lug 17 extend in directions parallel to one another. It is anticipated that the lug 17 will be situated at a height which is only a little more than twice the thickness of the strap 2, for maximum security of the free end of the strap when located between the two lugs. The support 20 for the lug 17 is also angled (in a similar manner to that shown for lug 11 in FIGS. 2 and 4) but this is mainly for the purpose of providing a good lead in for the free end of the strap 2 as it makes its first pass below the lugs and the bridge portion 3.

It will be appreciated that it would be possible to have the lug 16 lying in the lower plane with the lug 17 in the higher plane, but this is less preferred. Also the angles of the supports 18 and 20 may be varied, as desired, although the arrangement shown in FIGS. 4 and 5 is preferred.

An additional advantageous feature is the provision of a further upstanding lug 21 which prevents undue lateral movement of the end of the strap 2 and also prevents the end of the strap from adopting an inclined attitude.

The bridge portion 3 is positioned sufficiently inwardly of the edges of the plate 15 to avoid undue weakening in the tensile strength of the plate. Furthermore the effective width of the bridge 3 is only a little more than the width of the strap 2. The bridge 3 is also of a height comparable to that for the lug 17.

A central portion 22 of the plate has been cut out to reduce the stiffness of the plate 15 so that the plate can readily be bent to provide a smooth contour of the cable tie around a bundle which is gripped by the tie. The cut outs from which bridge portion 3 and the lugs 16, 17 and 21 are formed additionally help in this respect.

I claim:

1. A cable tie comprising a plate formed with an upper face and a lower face, a strap projecting from said plate and terminating in a free end portion, said plate carrying a first upstanding bridge portion carried on said upper face of said plate and defining a passageway generally aligned with said strap and of a width greater than the width of said strap, a pair of lugs, upstanding lug supports carrying said lugs on said upper face of said plate so that said lugs project in opposite directions inwardly towards the longitudinal centreline of said strap and said bridge portion, at least the one of said lug supports nearest to said bridge portion lying in a vertical plane which points outwardly in the direction away from said bridge portion with respect to said longitudinal centreline, the lug supports additionally being displaced longitudinally with respect to one another to define a slot between them through which said free end portion of said strap, which has been wrapped around a cable, passed below said lugs and said bridge portion and bent back to overlie said bridge portion, can be manipulated to lie under said one lug, the width of said slot and the separation distance of said lug supports being such as to enable said free end portion of said strap to pass subsequently fully through said slot and then below the other of said lugs so that when said free end of said strap is aligned with said longitudinal centreline, said free end portion of said strap will be held securely below both said lugs.

2. A cable tie according to claim 1 wherein the free end of a first one of said lugs which is situated nearest to said bridge portion, defines an edge which lies parallel to the vertical plane of its support.

3. A cable tie according to claim 2, wherein the free end of the second one of said lugs defines an edge which lies parallel to said edge of said first lug.

4. A cable tie according to claim 1, wherein the separation distance between said lug supports is less than 1.5 times the width of said strap.

5. A cable tie according to claim 1, wherein the separation distance between said lug supports is less than the internal width of said bridge portion.

6. A cable tie according to claim 1, wherein the internal width of said bridge is little more than the width of said strap.

7. A cable tie according to claim 1, incorporating a third lug comprising an upstanding portion only, which is located directly opposite the one of said pair of lugs which is positioned furthest from said bridge.

8. A cable tie according to claim 1, wherein said lugs are pressed out from the body of said plate.

9. A cable tie according to claim 7, wherein said lugs are pressed out from the body of said plate.

10. A cable tie according to claim 1, wherein portions of said plate are cut away to enhance the flexibility of said plate.

* * * * *